US008134523B2

(12) United States Patent
Fish

(10) Patent No.: US 8,134,523 B2
(45) Date of Patent: Mar. 13, 2012

(54) ACTIVE MATRIX DISPLAY DEVICES

(75) Inventor: David A. Fish, Haywards Heath (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 1368 days.

(21) Appl. No.: 10/597,096

(22) PCT Filed: Jan. 13, 2005

(86) PCT No.: PCT/IB2005/050154

§ 371 (c)(1),
(2), (4) Date: Jul. 11, 2006

(87) PCT Pub. No.: WO2005/076254

PCT Pub. Date: Aug. 18, 2005

(65) Prior Publication Data

US 2009/0015521 A1 Jan. 15, 2009

(30) Foreign Application Priority Data

Jan. 17, 2004 (GB) ..... 0401035.1

(51) Int. Cl.
*G09G 3/30* (2006.01)

(52) U.S. Cl. ..... 345/76; 315/169.3; 345/82

(58) Field of Classification Search ..... 345/204, 345/55, 207, 76–83, 690, 211–213; 315/169.1, 315/169.3

See application file for complete search history.

(56) References Cited

U.S. PATENT DOCUMENTS

2001/0055008 A1 12/2001 Young et al.
2003/0142047 A1 * 7/2003 Inoue et al. ..... 345/82

FOREIGN PATENT DOCUMENTS

| | | | |
|---|---|---|---|
| EP | 0717446 | A2 | 6/1996 |
| EP | 0923067 | A1 | 6/1999 |
| JP | 2003241711 | A * | 8/2003 |
| WO | 9636959 | A2 | 11/1996 |
| WO | 03038798 | A2 | 5/2003 |

OTHER PUBLICATIONS

S.K. Bhowmick et al, "An Improved Four TFT Circuit for Active-Matrix Organic Light Emitting Diode (OLED) Display", 2002 SID International Symposium Digest of Technical Papers, Boston, MA, May 21-23, 2002, vol. 33/1, pp. 606-609.

Y-C Lin et al, "Current Driving Pixel Circuities for Active Matrix Organic Light Emitting Diode Display", 2002 SID International Symposium Digest of Technical Papers, Boston, MA, May 21-23, 2002, vol. 33/1, pp. 610-613.

* cited by examiner

*Primary Examiner* — Stephen Sherman

(57) ABSTRACT

An active matrix display device stores a transistor drive voltage on a storage capacitor (24; Cs). A light-dependent device (27) effects discharge of the storage capacitor in dependence on the light output of the light emitting display element (2). Power is provided to each pixel from a first power line (26), and one of the light dependent device and the storage capacitor is coupled to a second power supply line (50), to which a varying voltage is provided during a pixel illumination period. By varying the voltage on one of the power supply lines, the discharge characteristics of the capacitor by the optical feedback system are altered to provide compensation for the light-dependent device leakage currents.

16 Claims, 5 Drawing Sheets

ACTIVE MATRIX DISPLAY DEVICES

This invention relates to active matrix display devices, particularly but not exclusively active matrix electroluminescent display devices having thin film switching transistors associated with each pixel.

Matrix display devices employing electroluminescent, light-emitting, display elements are well known. The display elements may comprise organic thin film electroluminescent elements, for example using polymer materials, or else light emitting diodes (LEDs) using traditional III-V semiconductor compounds. Recent developments in organic electroluminescent materials, particularly polymer materials, have demonstrated their ability to be used practically for video display devices. These materials typically comprise one or more layers of a semiconducting conjugated polymer sandwiched between a pair of electrodes, one of which is transparent and the other of which is of a material suitable for injecting holes or electrons into the polymer layer.

The polymer material can be fabricated using a CVD process, or simply by a spin coating technique using a solution of a soluble conjugated polymer. Ink-jet printing may also be used. Organic electroluminescent materials can be arranged to exhibit diode-like I-V properties, so that they are capable of providing both a display function and a switching function, and can therefore be used in passive type displays. Alternatively, these materials may be used for active matrix display devices, with each pixel comprising a display element and a switching device for controlling the current through the display element.

Display devices of this type have current-addressed display elements, so that a conventional, analogue drive scheme involves supplying a controllable current to the display element. It is known to provide a current source transistor as part of the pixel configuration, with the gate voltage supplied to the current source transistor determining the current through the display element. A storage capacitor holds the gate voltage after the addressing phase.

FIG. 1 shows a known active matrix addressed electroluminescent display device. The display device comprises a panel having a row and column matrix array of regularly-spaced pixels, denoted by the blocks 1 and comprising electroluminescent display elements 2 together with associated switching means, located at the intersections between crossing sets of row (selection) and column (data) address conductors 4 and 6. Only a few pixels are shown in the Figure for simplicity. In practice there may be several hundred rows and columns of pixels. The pixels 1 are addressed via the sets of row and column address conductors by a peripheral drive circuit comprising a row, scanning, driver circuit 8 and a column, data, driver circuit 9 connected to the ends of the respective sets of conductors.

The electroluminescent display element 2 comprises an organic light emitting diode, represented here as a diode element (LED) and comprising a pair of electrodes between which one or more active layers of organic electroluminescent material is sandwiched. The display elements of the array are carried together with the associated active matrix circuitry on one side of an insulating support. Either the cathodes or the anodes of the display elements are formed of transparent conductive material. The support is of transparent material such as glass and the electrodes of the display elements 2 closest to the substrate may consist of a transparent conductive material such as ITO so that light generated by the electroluminescent layer is transmitted through these electrodes and the support so as to be visible to a viewer at the other side of the support. Typically, the thickness of the organic electroluminescent material layer is between 100 nm and 200 nm. Typical examples of suitable organic electroluminescent materials which can be used for the elements 2 are known and described in EP-A-0 717446. Conjugated polymer materials as described in WO96/36959 can also be used.

FIG. 2 shows in simplified schematic form a known pixel and drive circuitry arrangement for providing voltage-addressed operation. Each pixel 1 comprises the EL display element 2 and associated driver circuitry. The driver circuitry has an address transistor 16 which is turned on by a row address pulse on the row conductor 4. When the address transistor 16 is turned on, a voltage on the column conductor 6 can pass to the remainder of the pixel. In particular, the address transistor 16 supplies the column conductor voltage to a current source 20, which comprises a drive transistor 22 and a storage capacitor 24. The column voltage is provided to the gate of the drive transistor 22, and the gate is held at this voltage by the storage capacitor 24 even after the row address pulse has ended.

The drive transistor 22 in this circuit is implemented as a p-type TFT, so that the storage capacitor 24 holds the gate-source voltage fixed. This results in a fixed source-drain current through the transistor, which therefore provides the desired current source operation of the pixel.

In the above basic pixel circuit, for circuits based on polysilicon, there are variations in the threshold voltage of the transistors due to the statistical distribution of the polysilicon grains in the channel of the transistors. Polysilicon transistors are, however, fairly stable under current and voltage stress, so that the threshold voltages remain substantially constant.

The variation in threshold voltage is small in amorphous silicon transistors, at least over short ranges over the substrate, but the threshold voltage is very sensitive to voltage stress. Application of the high voltages above threshold needed for the drive transistor causes large changes in threshold voltage, which changes are dependent on the information content of the displayed image. There will therefore be a large difference in the threshold voltage of an amorphous silicon transistor that is always on compared with one that is not. This differential ageing is a serious problem in LED displays driven with amorphous silicon transistors.

In addition to variations in transistor characteristics there is also differential ageing in the LED itself. This is due to a reduction in the efficiency of the light emitting material after current stressing. In most cases, the more current and charge passed through an LED, the lower the efficiency.

It has been recognised that a current-addressed pixel (rather than a voltage-addressed pixel) can reduce or eliminate the effect of transistor variations across the substrate. For example, a current-addressed pixel can use a current mirror to sample the gate-source voltage on a sampling transistor through which the desired pixel drive current is driven. The sampled gate-source voltage is used to address the drive transistor. This partly mitigates the problem of uniformity of devices, as the sampling transistor and drive transistor are adjacent each other over the substrate and can be more accurately matched to each other. Another current sampling circuit uses the same transistor for the sampling and driving, so that no transistor matching is required, although additional transistors and address lines are required.

There have also been proposals for voltage-addressed pixel circuits which compensate for the ageing of the LED material. For example, various pixel circuits have been proposed in which the pixels include a light sensing element. This element is responsive to the light output of the display element and acts to leak stored charge on the storage capacitor in response to the light output, so as to control the integrated light output of the display during the address period. FIG. 3 shows one example of pixel layout for this purpose.

In the pixel circuit of FIG. 3, a photodiode 27 discharges the gate voltage stored on the capacitor 24. The EL display element 2 will no longer emit when the gate voltage on the drive transistor 22 reaches the threshold voltage, and the storage capacitor 24 will then stop discharging. The rate at which charge is leaked from the photodiode 27 is a function of the display element output, so that the photodiode 27 functions as a light-sensitive feedback device. It can be shown that the integrated light output, taking into the account the effect of the photodiode 27, is given by:

$$L_T = \frac{C_S}{\eta_{PD}}(V(0) - V_T) \quad [1]$$

In this equation, $\eta_{PD}$ is the efficiency of the photodiode, which is very uniform across the display, $C_S$ is the storage capacitance, V(0) is the initial gate-source voltage of the drive transistor and $V_T$ is the threshold voltage of the drive transistor. The light output is therefore independent of the EL display element efficiency and the circuit thereby provides aging compensation.

In the circuit of FIG. 3, the power line 26 is switched between two voltage levels so that the drive transistor can be turned off when the pixel is addressed, and there is no display element output during addressing. An alternative way to achieve this shown in FIG. 4 is to provide an additional transistor 17 for isolating the display element, and this can be controlled by the same gate control signal as the address transistor 16.

One of the performance limiting factors for the circuits of FIGS. 3 and 4 is the leakage current through the photodiode, and this leakage current can even approach the photocurrent levels.

According to the invention, there is provided an active matrix display device comprising an array of display pixels, each pixel comprising:

a current-driven light emitting display element;

a drive transistor for driving a current through the display element;

a storage capacitor for storing a voltage to be used for addressing the drive transistor; and a light-dependent device for effecting discharge of the storage capacitor in dependence on the light output of the light emitting display element, wherein power is provided to each pixel from a first power line, and wherein one of the light dependent device and the storage capacitor is coupled to a second power supply line, and wherein the device further comprises means for varying the voltage on the second power supply line during a pixel illumination period.

Each pixel is thus associated with two power supply lines. By varying the voltage on one of the power supply lines, the discharge characteristics of the capacitor by the optical feedback system are altered to provide compensation for the light-dependent device leakage currents.

The voltage on the second power supply line may be ramped during a pixel illumination period. By providing a ramp with constant slope, a constant compensation current effectively is generated which compensates for the leakage current. A more complicated second power supply line voltage may of course be used.

The light dependent device may comprise a discharge photodiode.

The storage capacitor is preferably connected between the gate of the drive transistor and one of the first and second power lines, and the light dependent device is then connected between the gate of the drive transistor and the other of the first and second power lines. The storage capacitor and the photodiode provide the optical feedback circuit, and these are connected between one fixed voltage line and one varying voltage line.

The storage capacitor can be connected between the gate of the drive transistor and the first (fixed) power line, and the light dependent device is then connected between the gate of the drive transistor and the second (correction) power line. The correction voltage is then coupled through the light dependent device.

Alternatively, the storage capacitor can be connected between the gate of the drive transistor and the second (correction) power line, and the light dependent device is connected between the gate of the drive transistor and the first power line.

The device may further comprise a discharge transistor for discharging the storage capacitor thereby to switch off the drive transistor, and the light-dependent device is then for controlling the timing of the operation of the discharge transistor by varying the gate voltage applied to the discharge transistor in dependence on the light output of the display element.

In this arrangement, the drive transistor can be controlled to provide a constant light output from the display element. The optical feedback, for aging compensation, is used to alter the timing of operation (in particular the turning on) of a discharge transistor, which in turn operates to switch off the drive transistor rapidly. The timing of operation of the discharge transistor can also be dependent on the data voltage to be applied to the pixel. In this way, the average light output can be higher and the display element can thus operate more efficiently.

The light-dependent device can control the timing of the switching of the discharge transistor from an off to an on state. A discharge capacitor may be provided between the gate of the discharge transistor and one of the first and second voltage lines, and the light dependent device is then for charging or discharging the discharge capacitor.

Each pixel can be adapted to draw substantially the same current from the first and second power lines. This means that any power line voltage drops are the same on the two lines. The gate-source voltage of the drive transistor can be determined by the difference between the two power supply lines, so that this arrangement compensates for power line voltage drops.

Each pixel may for example comprise a current mirror circuit for matching the currents drawn from the from the first and second power lines.

The invention also provides a method of driving an active matrix display device comprising an array of display pixels each comprising a drive transistor and a current-driven light emitting display element, the method comprising, for each addressing of the pixel:

applying a drive voltage to an input of the pixel;

storing a voltage derived from the drive voltage on a discharge capacitor;

driving the drive transistor using a voltage on a storage capacitor;

discharging the storage capacitor using a light sensitive element, at a rate or time dependent on the light output of the display element, and varying a voltage on a terminal of the light sensitive element or the storage capacitor thereby to compensate for leakage currents of the light sensitive element.

The discharge capacitor and the storage capacitor may be one and the same component, or they may be separate components.

A first current is drawn by the drive transistor and a second current is drawn from said terminal of the light sensitive element or the storage capacitor, and the method may further comprise matching the first and second currents.

The invention will now be described by way of example with reference to the accompanying drawings, in which.

Figure 6A:
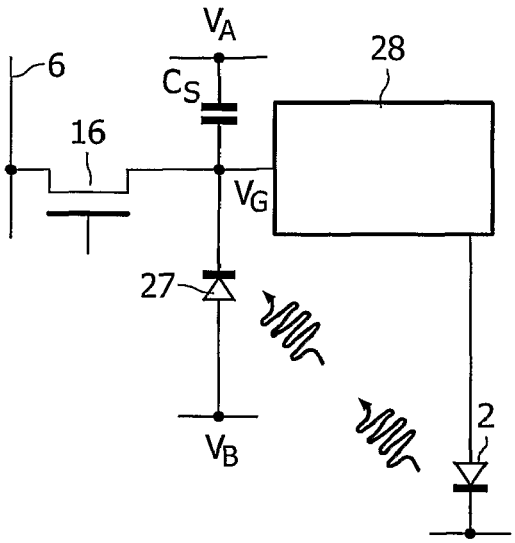
Figure 6B:
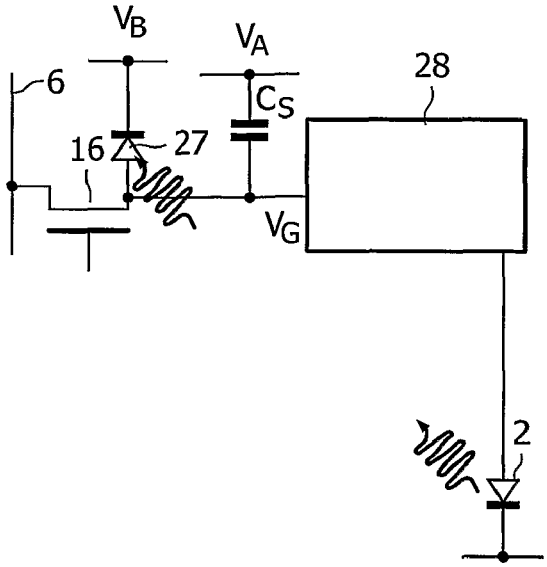
Figure 7:
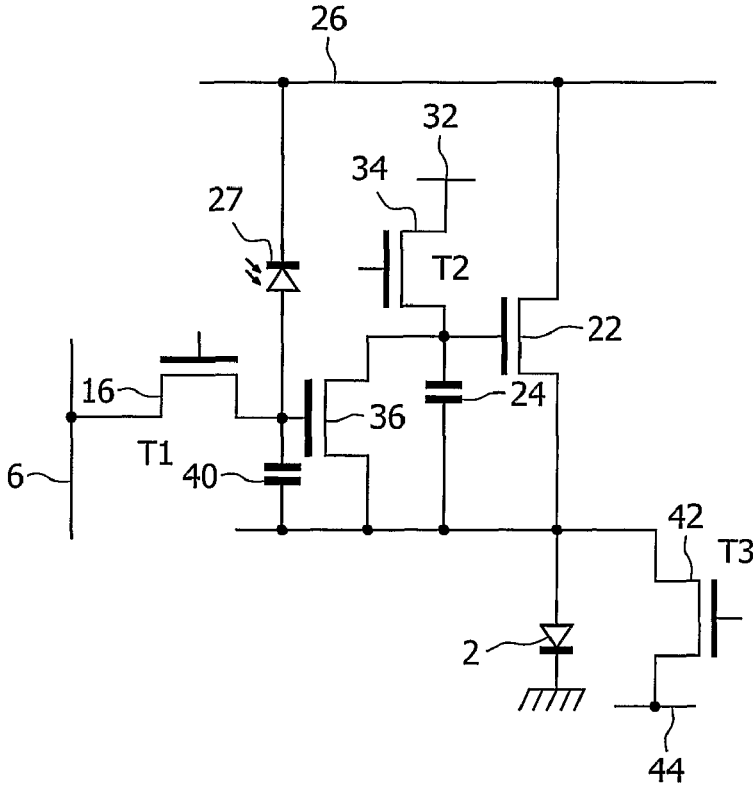
FIG. 7 PRIOR ART
Figure 8:
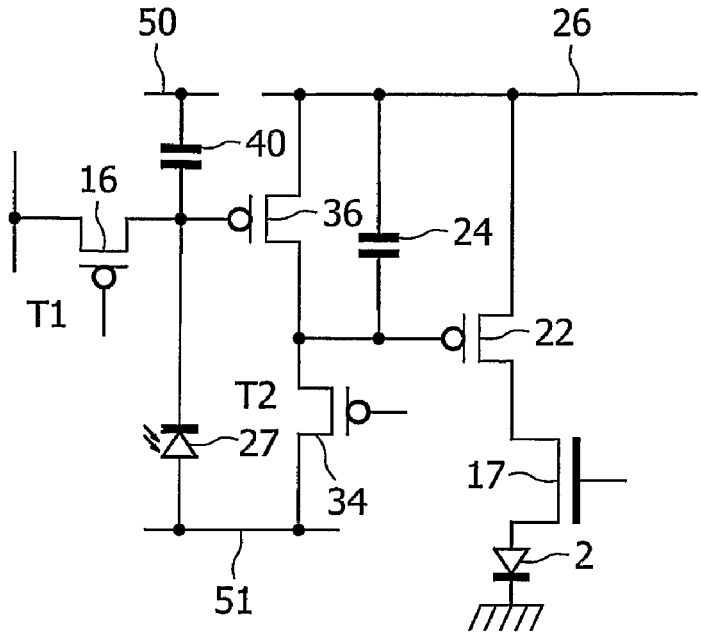
Figure 9:
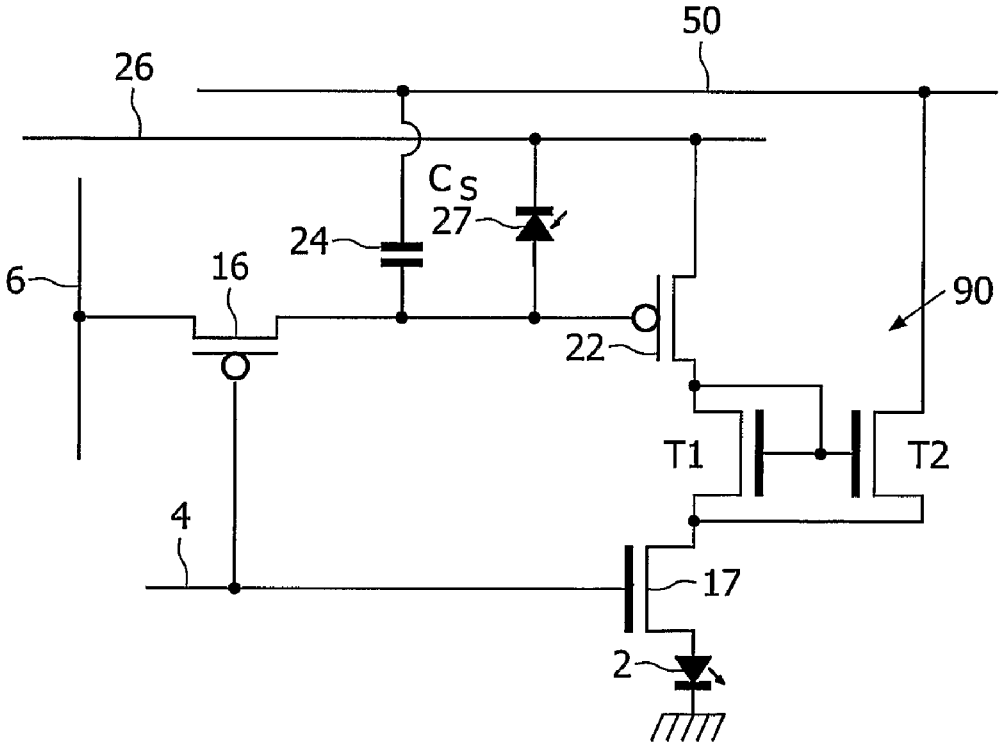

FIGS. 6*a* and 6*b* show two generalised examples of pixel circuit according to the invention;

FIG. 7 shows a third known pixel design which compensates for differential aging;

FIG. 8 shows a second example of pixel circuit according to the invention which is a modification to the circuit of FIG. 7; and FIG. 9 shows a third example of pixel circuit according to the invention.

It should be noted that these figures are diagrammatic and not drawn to scale. Relative dimensions and proportions of parts of these figures have been shown exaggerated or reduced in size, for the sake of clarity and convenience in the drawings.

In accordance with the invention, the optical feedback system of the storage capacitor and the photodiode is controlled to compensate for dark currents of the photodiode. This is achieved by associating the capacitor and the photodiode with different power supply lines, and the voltage on one of the power supply lines is varied during a pixel illumination period. The effect of leakage currents on the optical feedback charging or discharging of the capacitor can then be cancelled.

Figure 1:
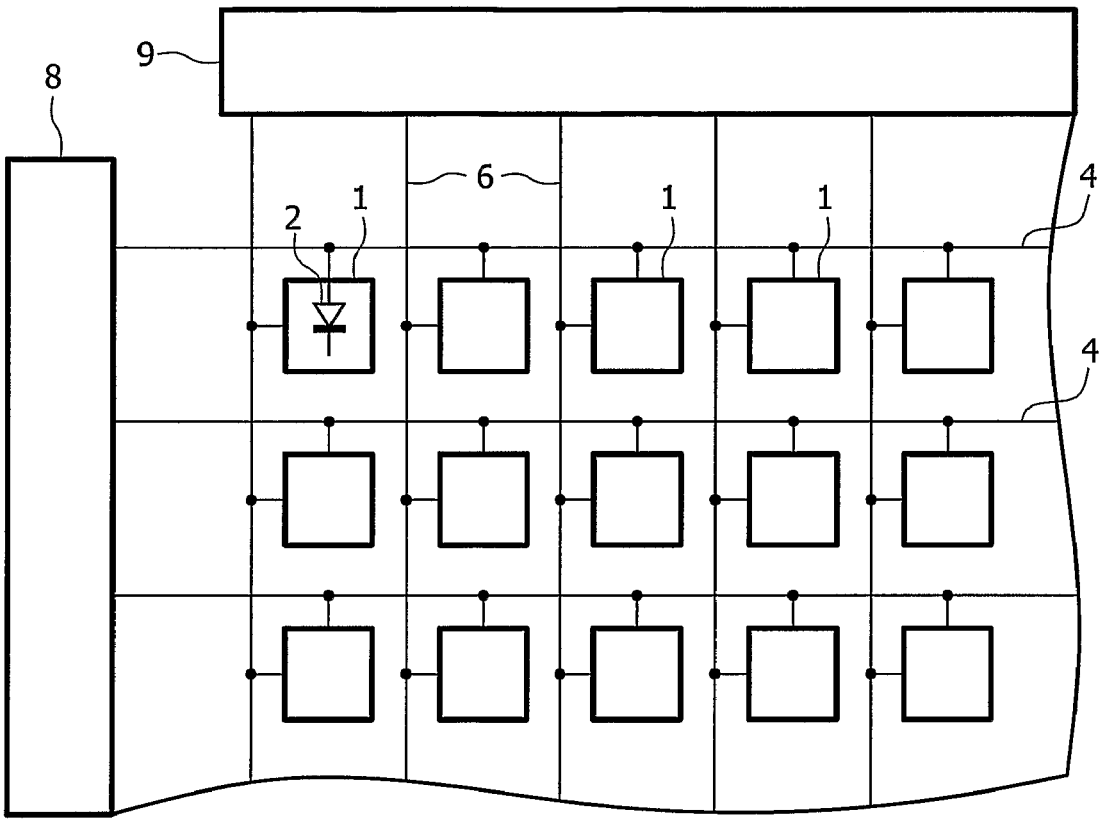
FIG. 1 PRIOR ART
FIG. 1 shows a known EL display device.
Figure 2:
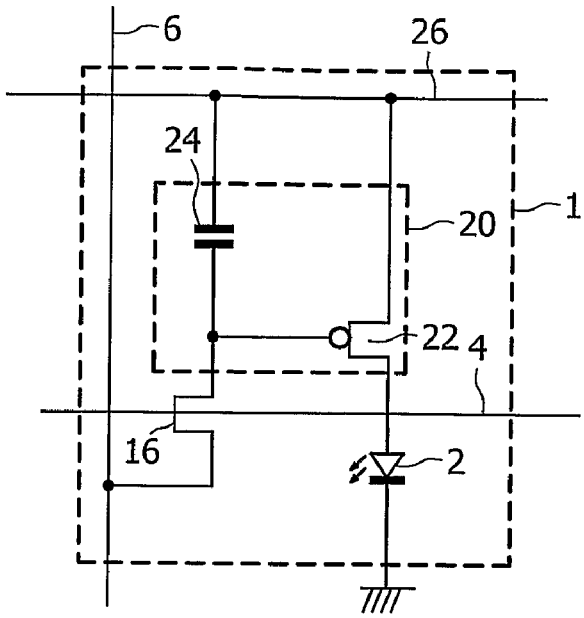
FIG. 2 PRIOR ART
FIG. 2 is a simplified schematic diagram of a known pixel circuit for current-addressing the EL display pixel.
Figure 3:
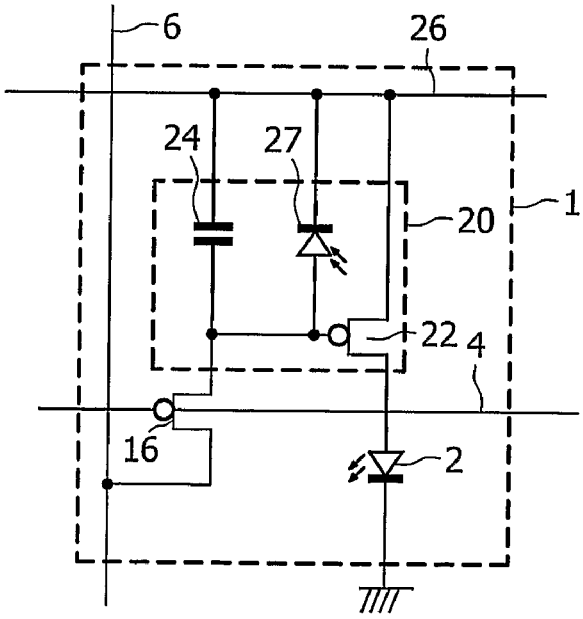
FIG. 3 PRIOR ART
FIG. 3 shows a first known pixel design which compensates for differential aging.
Figure 4:
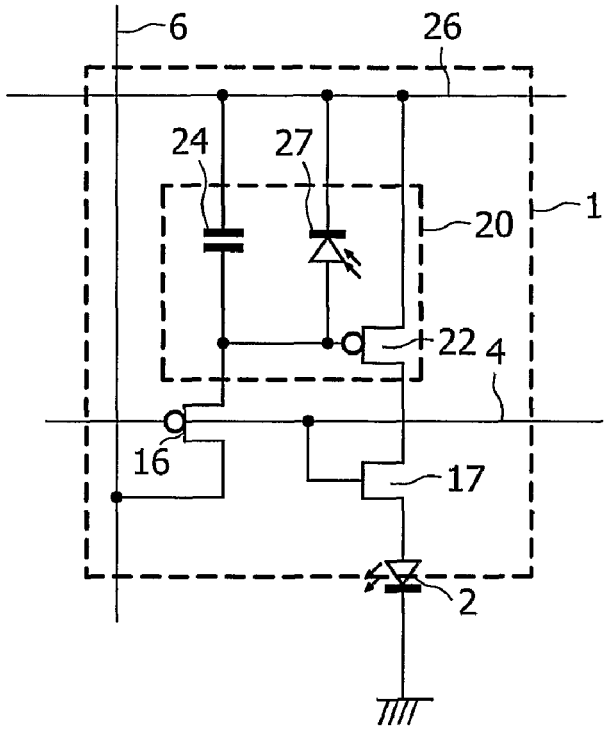
FIG. 4 PRIOR ART
FIG. 4 shows a second known pixel design which compensates for differential aging.
Figure 5:
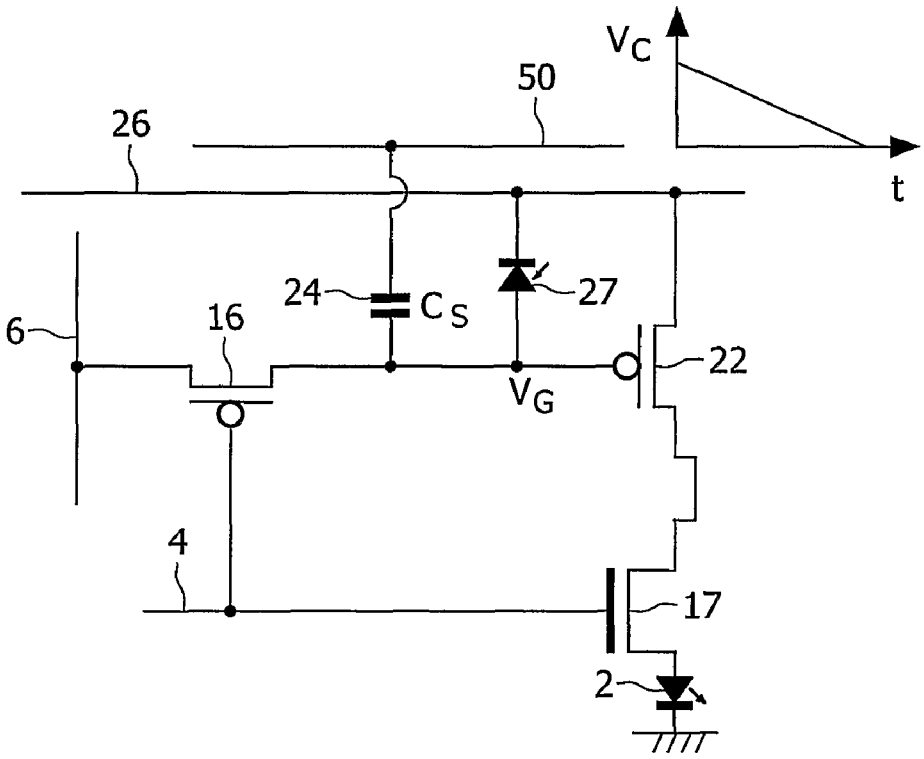
FIG. 5 shows a first example of pixel circuit according to the invention.

FIG. 5 shows a first example of pixel layout of the invention. The same reference numerals are used to denote the same components as in FIGS. 2 to 4, and the pixel circuit is for use in a display such as shown in FIG. 1.

The storage capacitor 24 is connected between the drive transistor gate and a second, correction, power supply line 50 which is controlled to correct for leakage (dark) photodiode currents. A correction voltage profile $V_C$ is applied to the line 50.

The currents that flow at the gate node of the drive transistor 22 during pixel illumination (with transistor 16 off) are given by the equation:

$$-C_S\frac{dV_G}{dt} = I_{PD} + I_L \qquad [2]$$

where $I_{PD}$ is the photo-current and $I_L$ is the leakage current and these together equal the current that is discharging the storage capacitor 24.

The leakage current shown in equation [2] is cancelled in the circuit of the invention, by creating a current at the gate node of the drive TFT 22 of opposite magnitude to $I_L$.

In the simplest implementation, it can be assumed that the leakage current will be the same for every pixel in the display and that this current is constant over the frame time. By adjusting the voltage on the correction line 50 shown in FIG. 5 so that it has a constant rate of voltage change, a current at the gate of the drive TFT 22 can be generated so that the leakage current is cancelled. Equation [2] becomes:

$$-C_S\frac{dV_G}{dt} - C_S\frac{dV_C}{dt} = I_{PD} + I_L$$

If the rate of change of $V_C$ is chosen correctly, then:

$$-C_S\frac{dV_C}{dt} = I_L \qquad [3]$$

Thus, the leakage current is cancelled.

In the circuit of FIG. 5, the photodiode current causes charge to flow to the lower voltage terminal of the capacitor, reducing the voltage across the capacitor, and raising the gate voltage towards the voltage on the line 50, until the transistor 22 is switched off. The leakage current tends to discharge the storage capacitor 24 faster than it should. By reducing the voltage on the correction line 50 slowly, the gate-source voltage lost as a result of the leakage current is replaced. Thus, the change in voltage across the capacitor as a result of the leakage current is accommodated by voltage changes on the correction line 50 rather than voltage changes at the gate. The evolution of the gate-source voltage is therefore dependent on the photocurrent only and not the dark current of the photodiode.

By way of example, if the leakage current is 100 pA and the storage capacitor is 1 pF, then $dV_C/dt$=100 V/sec, so over a frame time of 10 ms the voltage range on the correction line will be 1V.

This analysis assumes a constant leakage current. If the leakage current varies over the frame time, or if there is unwanted photo-current due to light coupling into the pixel from the glass substrate, then the voltage on the correction line will need to be varied in a different manner.

From equation [3] if the current $I_L$ is known as a function of time then equation [3] can be integrated to find the form of the voltage $V_C$ that needs to be applied to the correction line 50.

The voltage profile to be applied to the correction line 50 can be generated within the row driver circuit 8 of FIG. 1, together with the other row voltage waveforms. Thus, the row driver 8 of FIG. 1 is modified to include a circuit providing an output for varying the voltage on the second power supply line 50 during a pixel illumination period. The generation of voltage waveforms within the row driver, and the timing control to enable the row waveforms to be applied row by row will be routine to those skilled in the art.

This type of correction can of be generalised to any pixel circuit that has a photo-sensor charging or discharging a capacitor to enable an optical feedback correction. A generalised circuit is shown in FIGS. 6*a* and 6*b*.

FIGS. 6*a* and 6*b* show that there are two possible lines to sweep to create a current that will cancel the leakage currents.

The two circuits in FIG. 6 each comprise a "generalised pixel circuit", 28, to which a control voltage $V_G$ is applied. This may the gate voltage for the drive transistor of the pixel circuit, but there may be other components between the input $V_G$ and the drive transistor. The circuit of FIG. 6*a* uses the photodiode current to remove charge from the storage capacitor $C_S$ and the circuit of FIG. 6*b* uses the photodiode current to provide charge to the storage capacitor $C_S$. In each case, the voltage line for the common photodiode terminal and the voltage line for the common capacitor terminal can be used to provide correction for the photodiode dark current.

It is possible to sweep the line connected to the photodiode because the photodiode has its own self-capacitance. In many cases this may be preferable since sweeping the line connected to the capacitor can create difficulties when there are power line voltage drops.

With reference to FIGS. 6*a* and 6*b*, the currents at the node $V_G$ are:

$$C_S\frac{d(V_A - V_G)}{dt} + C_{PD}\frac{d(V_G - V_B)}{dt} = -I_{PD} - I_L$$

where $C_{PD}$ is the photo-sensor self capacitance. It is then possible to set:

$$C_{PD}\frac{dV_B}{dt} = I_L$$

to remove leakage current effects (assuming $V_A$ is constant in time).

As explained with reference to FIG. 6, the invention can be applied to many other pixel circuits. One problem encountered in LED displays is that the threshold voltage of the drive transistors can vary across the display, so that the display will exhibit non-uniformity. The conventional optical feedback pixels described above do not compensate for this. Furthermore, these optical feedback pixels provide a light output which tails off, giving a lower average brightness intensity.

FIG. 7 shows a modified optical feedback pixel which can also be modified by the invention. FIG. 7 is an implementation with all n-type transistors, which can be implemented in amorphous silicon.

The gate-source voltage for the drive transistor 22 is again held on a storage capacitor 24. However, the capacitor is charged to a fixed voltage from a charging line 32, by means of a charging transistor 34 (T2). Thus, the drive transistor 22 is driven to a constant level which is independent of the data input to the pixel when the display element is to be illuminated. The brightness is controlled by varying the duty cycle, in particular by varying the time when the drive transistor is turned off.

The drive transistor 22 is turned off by means of a discharge transistor 36 which discharges the storage capacitor 24. When the discharge transistor 36 is turned on, the capacitor 24 is rapidly discharged and the drive transistor turned off.

The discharge transistor 36 is turned on when the gate voltage reaches a sufficient voltage. A photodiode 27 is again illuminated by the display element 2 and generates a photocurrent in dependence on the light output of the display element 2. This photocurrent charges a discharge capacitor 40, and at a certain point in time, the voltage across the capacitor 40 will reach the threshold voltage of the discharge transistor 36 and thereby switch it on. This time will depend on the charge originally stored on the capacitor 40 and on the photocurrent, which in turn depends on the light output of the display element.

The photodiode 27 is shown connected to the power line 26, but it may instead connect to the charging line 32.

Thus, the data signal provided to the pixel on the data line 6 is supplied by the address transistor 16 (T1) and is stored on the discharge capacitor 40. A low brightness is represented by a high data signal (so that only a small amount of additional charge is needed for the transistor 36 to switch off) and a high brightness is represented by a low data signal (so that a large amount of additional charge is needed for the transistor 36 to switch off).

This circuit thus has optical feedback for compensating ageing of the display element, and also has threshold compensation of the drive transistor 22, because variations in the drive transistor characteristics will also result in differences in the display element output, which are again compensated by the optical feedback. For the transistor 36, the gate voltage over threshold is kept very small or negative, so that the threshold voltage variation is much less significant.

In the implementation of FIG. 7, each pixel also has a bypass transistor 42 (T3) connected between the source of the drive transistor 22 and a bypass line 44. This bypass line 44 can be common to all pixels. This is used to ensure a constant voltage at the source of the drive transistor when the storage capacitor 24 is being charged. Thus, it removes the dependency of the source voltage on the voltage drop across the display element, which is a function of the current flowing. Thus, a fixed gate-source voltage is stored on the capacitor 24, and the display element is turned off when a data voltage is being stored in the pixel.

The power supply line has a switched voltage applied to it, so that during the writing of data to the pixel, the power supply line 26 is switched low, so that the drive transistor 22 is turned off. This enables the bypass transistor 42 to provide a good ground reference.

FIG. 8 shows a circuit which operates in the same manner as explained with reference to FIG. 7, but which is an implementation with a p-type drive transistor and which has been modified to benefit from the invention. FIG. 8 shows an n-type and p-type circuit, suitable for implementation using a low temperature polysilicon process.

In this circuit, charge is removed from the capacitor 40 by the photodiode 27 to result in a drop in the gate voltage of the discharge transistor 36 until it turns on.

The isolating transistor 17 enables the display element 2 to be turned off during the addressing phase so that black performance is preserved. In FIG. 8, this is an n-type device, although it may of course be a p-type device so that an implementation with all p-type devices is possible.

In accordance with the invention, the capacitor 40 is connected to a correction line 50 rather than to the power supply line 26, and the correction voltage is applied to this line. As explained with reference to FIG. 6, the correction voltage may instead be applied to the photodiode charge line 51. In this example, sweeping the photodiode charge line 51 is advantageous as the capacitor can then be connected to the power line 26, removing the need for the separate correction line 50 shown in FIG. 8.

A further problem encountered with LED display devices results from the power line voltage drops. For a given gate drive voltage, these result in different gate-source voltages. These variations in gate source voltage are provide undesirable image artifacts, and as they are dependent on the image they are difficult to correct easily. The circuits described above do not compensate for these power line voltage drops.

By providing separate power lines, the invention provides an opportunity to correct for these power line voltage drops. A correction scheme can be implemented by ensuring the correction lines and power lines draw the same current so both have the same level of voltage drop. In particular, the gate-source voltage is defined by the difference between the correction line 50 and the power supply line 26.

In the circuit of FIG. 9, a current mirror 90 is provided between the drive TFT 22 and the LED 2, and connected to the correction line 50. The current mirror comprises a first transistor T1 through which the drive transistor current passes from the power supply line 26. A second transistor T2 has the same gate-source voltage and draws current from the correction line 50. The current through both transistors passes through the display element 2. This enables the correction line 50 and the power supply line 26 to draw the same currents and thereby overcome the voltage drop problem.

In this way, if there were no voltage sweep on the correction line, the voltage difference between the two lines would be constant across the array. The correction line 50 does still has a voltage sweep applied to it, but the current mirror in the pixel ensures that the currents drawn from this line equal the currents drawn by the drive TFT. Adding in the voltage sweep means that the two lines have a difference equal to the voltage sweep across the array. The resulting drain-source change on T2 does not matter as this transistor is operating in a saturated regime.

The current mirror requires TFT matching between the transistors T1 and T2.

In the examples above, the light dependent element is a photodiode, but pixel circuits may be devised using phototransistors or photoresistors. Circuits have been shown using a variety of transistor semiconductor technologies. A number of variations are possible, for example crystalline silicon, hydrogenated amorphous silicon, polysilicon and even semiconducting polymers. These are all intended to be within the scope of the invention as claimed. The display devices may be polymer LED devices, organic LED devices, phosphor containing materials and other light emitting structures.

A number of different pixel circuits have been given above, and certain specific features and improvements have been explained only with reference to individual embodiments. It should be understood that any specific features and improvements can be applied to other embodiments where appropriate. For example, the current mirror shown in FIG. 9 can be applied to n-type amorphous silicon circuits.

The circuits above are also common cathode implementations of the display element with the circuitry controlling current flow to the anode, but common anode implementations are also possible.

Many other pixel variations are possible. For example, some pixel configurations can compensate for the stress induced threshold voltage variations of an amorphous silicon drive transistor, whereas other pixel configurations can compensate for the distribution of threshold voltage values over an array of polysilicon drive transistors. Additional circuit elements for these compensation operations can also be added to pixel circuits of the invention. In general, any optical feedback pixel can be modified to benefit from this invention.

The timing for the operation of the circuit of the invention has not been described in detail. However, the timing diagrams for the circuit being modified by the invention will not be altered. The invention requires an additional waveform for the correction line, and as explained above this will vary over time during pixel illumination. A constant voltage will be applied to the correction line during pixel addressing, so that during pixel addressing, the correction line operates as if connected to the power supply line.

Various other modifications will be apparent to those skilled in the art.

The invention claimed is:

1. An active matrix display device comprising an array of display pixels, each pixel comprising:

a current-driven light emitting display element;

a drive transistor for driving a current through the display element;

a storage capacitor ($C_s$) for storing a voltage to be used for addressing the drive transistor; and a light-dependent device for effecting discharge of the storage capacitor in dependence on the light output of the light emitting display element, wherein power is provided to each pixel from a first power line, and wherein one of the light dependent device and the storage capacitor is coupled to a second power supply line, and wherein the device further comprises means for varying the voltage on the second power supply line during a pixel illumination period, and wherein the voltage on the second power supply line is ramped during a pixel illumination period to cancel a leakage current $I_L$ at a gate node of the drive transistor by creating a current of opposite magnitude of the leakage current $I_L$.

2. A device as claimed in claim 1, wherein the light dependent device (27) comprises a discharge photodiode.

3. A device as claimed in claim 1, wherein each pixel further comprises an address transistor connected between a data signal line and an input to the pixel.

4. A device as claimed in claim 1, wherein the drive transistor is connected between a power supply line and the display element.

5. A device as claimed in claim 1, wherein each pixel further comprises an isolating transistor connected in series with the drive transistor.

6. A device as claimed in claim 1, wherein the storage capacitor is connected between the gate of the drive transistor and one of the first and second power lines, and wherein the light dependent device is connected between the gate of the drive transistor and the other of the first and second power lines.

7. A device as claimed in claim 6, wherein the storage capacitor is connected between the gate of the drive transistor and the first power line, and the light dependent device is connected between the gate of the drive transistor and the second power line.

8. A device as claimed in claim 7, wherein the storage capacitor (24) is connected between the gate of the drive transistor (22) and the second power line, and the light dependent device (27) is connected between the gate of the drive transistor (22) and the first power line.

9. A device as claimed in claim 1, further comprising a discharge transistor (36) for discharging the storage capacitor (24) thereby to switch off the drive transistor (22), and wherein the light-dependent device (27) is for controlling the timing of the operation of the discharge transistor by varying the gate voltage applied to the discharge transistor (36) in dependence on the light output of the display element (2).

10. A device as claimed in claim 9, wherein the light-dependent device (27) controls the timing of the switching of the discharge transistor (36) from an off to an on state.

11. A device as claimed in claim 9, wherein a discharge capacitor (40) is provided between the gate of the discharge transistor (36) and one of the first and second voltage lines, and the light dependent device (27) is for charging or discharging the discharge capacitor (40).

12. A device as claimed in claim 9, wherein each pixel further comprises a charging transistor (34) connected between the second power line and the gate of the drive transistor (22).

13. A device as claimed in claim 1, wherein each pixel is adapted to draw substantially the same current from the first and second power lines.

14. A device as claimed in claim 13, wherein each pixel further comprises a current mirror circuit (90) for matching the currents drawn from the from the first and second power lines (26,50).

15. A method of driving an active matrix display device comprising an array of display pixels each comprising a drive transistor and a current-driven light emitting display element, the method comprising, for each addressing of the pixel:

applying a drive voltage to an input of the pixel;

storing a voltage derived from the drive voltage on a discharge capacitor;

driving the drive transistor using a voltage on a storage capacitor;

discharging the storage capacitor using a light sensitive element, at a rate or time dependent on the light output of the display element, and varying a voltage on a terminal of the light sensitive element or the storage capacitor thereby to compensate for leakage currents of the light sensitive element wherein the voltage on the terminal of the light sensitive element or the storage capacitor is ramped during a pixel illumination period to cancel a leakage current $I_L$ at a gate node of the drive transistor by creating a current of opposite magnitude of the leakage current $I_L$.

16. A method as claimed in claim 15, wherein a first current is drawn by the drive transistor and a second current is drawn from said terminal of the light sensitive element or the storage capacitor, and wherein the method further comprises matching the first and second currents.

* * * * *